United States Patent [19]

Fry

[11] 3,950,577

[45] Apr. 13, 1976

[54] COMPRESSION IMPREGNATION OF WOOD VENEERS

[75] Inventor: Harry J. Fry, Orrville, Ohio

[73] Assignee: Koppers Company, Inc., Pittsburgh, Pa.

[22] Filed: Nov. 7, 1973

[21] Appl. No.: 413,524

[52] U.S. Cl. ..... 427/365; 144/246 R; 144/282; 427/440

[51] Int. Cl.[2] .... B05D 3/12; B05D 1/18; B27D 3/00

[58] Field of Search ..... 117/47 R, 57, 59, 147, 117/148, 65.2; 21/7; 34/13.8, 14, 18, 70; 144/282, 246 R; 427/365, 440

[56] References Cited

UNITED STATES PATENTS

| | | | |
|---|---|---|---|
| 128,387 | 6/1872 | Gyles | 34/14 |
| 1,644,801 | 10/1927 | Van Der Werft | 21/7 |
| 1,677,963 | 7/1928 | Ford | 21/7 |
| 2,064,965 | 12/1936 | Will | 117/57 |
| 2,350,135 | 5/1944 | Stamm | 117/59 |
| 2,711,591 | 6/1955 | Wellmar | 34/18 |
| 3,183,606 | 5/1965 | Gustatsson et al. | 34/70 |
| 3,398,011 | 8/1968 | Neirotti | 117/65.2 |
| 3,427,186 | 2/1969 | Hudson | 21/7 |
| 3,507,053 | 4/1970 | Goulet | 34/13.8 |
| 3,624,233 | 11/1971 | Goulet | 117/47 R |

FOREIGN PATENTS OR APPLICATIONS

| | | | |
|---|---|---|---|
| 597,338 | 1/1948 | United Kingdom | 34/13.8 |
| 624,023 | 5/1949 | United Kingdom | 34/13.8 |
| 684,915 | 4/1964 | Canada | 34/14 |

*Primary Examiner*—Michael R. Lusignan
*Attorney, Agent, or Firm*—Herbert J. Zeh, Jr.; Oscar B. Brumback

[57] ABSTRACT

Wood veneers are compression treated by passing the veneers between compression rollers while submerged in a treating solution. The veneers are passed between the rollers in multiple layers with the direction of feed being parallel to the grain or cell orientation of the veneers. The veneers have an original moisture content above the fiber saturation point and are compressed to about one-half their original thickness.

12 Claims, No Drawings

COMPRESSION IMPREGNATION OF WOOD VENEERS

BACKGROUND OF THE INVENTION

This invention is directed to an improved method for compression impregnating wood veneer with water borne chemical agents. More specifically, this invention is directed to the treating of wood veneers comprising passing multiple layers of the veneer between compression rollers while submerged in a solution of the treating compound. The veneers are fed into the compression rollers parallel to the grain or cell orientation and are compressed by the rollers perpendicular to the grain to about one-half of their original thickness. The veneers have an original moisture content above the fiber saturation point before compression.

It is well known in the art that plywood is a superior wood product when compared to other wood products. Plywood has near uniformity in strength properties in the direction of its two major axes and has increased resistance to end checking and splitting and a greatly reduced tendency to twist and warp. This superiority of plywood is largely due to the manner in which plywood is constructed. Wood is an exceedingly anisotropic material with its flexural strength perpendicular to the grain being about one-fourth of the flexural strength in the direction of the grain. Similarly, the shrinkage and swelling of wood are highly directional. Plywood, by changing the grain direction of successive layers by 90°, minimizes these variations. Therefore, plywood is a highly desirable wood product.

Because of the desirability of plywood it is becoming more and more common and desirable in the industry to treat plywood with fire retarding chemicals, preservatives, stabilizers and other wood treating agents. However, the present method of treating plywood at pressure treating plants requires several very costly handlings, a kiln drying operation which often results in undesirable sticker marks and other damage, and a process time of 30 days or longer. Because of these drawbacks treated plywood is not as economically attractive as would be desirable.

It is obvious that there would be a large economic advantage in being able to manufacture treated plywood from veneers which have been treated as they came from the veneer lathe and before drying. Such a procedure would produce treated plywood without sticker marks and other defects associated with pressure treatment and kiln drying. In addition, such a procedure would not require the costly handling steps and the long process times. The treated plywood could be produced at minimal cost right at the plywood mill where it could then be shipped through normal channels to customers. However, heretofore there was not available to the art an effective and economical method for treating green veneers as they came from the lathe.

It has been proposed in the past to treat veneers by passing a single layer of the veneer through pressure rollers while submerged in a solution of the treating agent. See, for example, Stamm, U.S. Pat. No. 2,350,135. However, the Stamm process was never commercialized because of several severe drawbacks. First of all, the Stamm process required the veneers to be preheated prior to passing them between the pressure rollers. The wood must be plasticized by first heating it to about 200°–300°F. This step is expensive and time consuming and adds appreciable costs to the process. In addition it is incompatable with most preservative and fire retarding agents.

Another drawback of the Stamm process is that the green veneer must be presqueezed to remove water from the green veneer before it is passed through the compression rollers which are submerged in the treating solution. According to Stamm, the wood must not have water concentrations greater than the fiber saturation point. If the water concentration is greater than the fiber saturation point, then Stamm teaches that both the amount and rate of solution takeup are reduced. Most green veneer have water concentrations which are appreciably above the fiber saturation point. Therefore, it is necessary in the Stamm process to pass the green veneer through a pair of hot drying rollers to squeeze out the free water (above fiber saturation point) prior to passing the veneer through the rollers located in the treating bath. It is also necessary to remove this excess water from the presqueezer by blowing hot air over the wood surface at the point where the veneer passes between the rollers of the presqueezer. This treatment step is also costly and time consuming.

The most serious drawback of the Stamm process is that it seriously degrades the veneer during the squeeze treatment. When the veneer passes between the squeeze rollers of the Stamm the knots in the wood are crushed and damaged. As the knots are crushed, they split out and rupture the veneer; quite often the wood around the knot is also seriously damaged. Since it is well known that there are knots present in all veneers, this presents a serious problem. The higher grades of veneer (N and A) are degraded to grades C and D. In addition, some of the veneer cannot be used because of the damage.

The knot occurence in veneer depends on the species from which the veneer is cut, the grade of logs peeled and the depth in the log from which the veneer came. In some species there will be several knots per square foot whereas in others there will be only several knots in a 4 feet × 8 feet sheet. However, there are very very few sheets without knots. For example, veneers cut from spruce logs contain a very large number of knots often averaging several per square foot of veneer. These knots are small but cruse very easily when the sheets of veneer are compressed between steel rollers. Southern pine veneers also contain a large amount of knots most of which are relatively large in size. The large knots are always damaged when compressed between hard rollers. Because of the knot problem and the other drawbacks mentioned above, the use of compression treatment with rollers has not heretofore found commercial use for the treatment of veneers.

For examples of other compression based processes which have been patented but never commercialized see: British Pat. No. 1,060,014; British Pat. No. 1,174,713 and Goulet, U.S. Pat. No. 3,624,233. In addition see Finnish Pat. No. 34,854 and Varga U.S. Pat. No. 3,429,652.

Therefore, it is the object of this invention to provide an effective and economical process for treating green veneer as it comes from the lathe.

SUMMARY OF THE INVENTION

I have discovered an economical and effective method for treating green veneers as they come from the veneer lathe with a water borne treating agent. The method of my invention does not require any pretreatment of the green veneer and does not damage the veneer during treatment. My method allows the production of treated plywood at minimal costs right at the plywood mill.

The method of my invention comprises passing multiple layers of green veneer between compression rollers while submerged in a solution of the water borne chemicals. The veneers must be fed into the squeeze rollers parallel to the grain of the veneer and compressed perpendicular to the grain to about one-half of their original thickness. The veneers must have an original moisture content above the fiber saturation point. In addition the veneers may be recycled or subjected to several rollers to increase the preservative retention.

The method of my invention overcomes the prior art problem of knot crushing. The use of multiple layers of veneers eliminates the problem of knot crushing. By placing at least one veneer on top of another and compressing at least two layers of veneer at a time I have been able to eliminate the problem of knot crushing. The use of multiple layers also increases the production rate. Moreover, treating the veneers in this multiple layers fashion has little or no effect on the solution retention or distribution. Evaluation of veneers treated according to my invention indicate that the treatment is excellent. In addition, strength tests show the modulus of elasticity and modulus of rupture to be unaffected by the compression impregnation process.

I have attempted to overcome the knot crushing problem by constructing rollers out of various plastic materials, rubber materials, and metals covered with various plastic, rubber and the like. However, it was found that materials which were soft enough to prevent crushing and splitting knots were too soft to compress the veneer sufficiently for adequate treatment. Likewise, materials which were hard enough to compress the veneers sufficiently for adequate treatment caused the knots to be crushed and split.

However, when two or more veneers are compressed simultaneously, one on top of the other the problem of knot crushing and splitting is overcome. The green veneers compress sufficiently to compensate for the uncompressible knots in the other veneer, thus preventing crushing and splitting of the knots. However, this procedure does not materially affect the retention of the water borne treating agent.

As can be seen from the above it is very important and critical to the present invention to use multiple layers of veneer. If multiple layers are not employed the benefits of the invention are not realized. By multiple layers is meant more than one layer of veneer. The maximum number of layers that my be effectively compressed in accordance with this invention will depend upon such factors as the thickness of the individual veneers, the species of veneer wood, the treating agent and the degree of treatment retention desired. However, for all practical purposes the number of layers of veneer will seldom if ever exceed 5. The most practical number of layers of veneer and hence the preferred number of layers is 2 or 3. The use of the multiple layers of veneer does not materially affect the treatment of the veneer. All of the board surfaces of the various veneer layers are effectively treated by the process of my invention.

As mentioned above, my invention comprises simultaneously compressing more than one layer of veneer between compression rollers while the veneers are submerged in a solution of the water borne preservative. It is very important that the veneers are submerged in the treating solution when they emerge from the compression rollers. Therefore, it is not necessary that the compression rollers are completely submerged in the treating solution so long as the veneers are submerged when they emerge from the squeeze rollers. For example, the rollers may be located at the water air interface with the downward side of the rollers being submerged. However, the easiest way of making sure the veneers are submerged when they emerge from the squeeze rollers is to have the compresion rollers stragetically located under the solution of water borne chemical agents. Most often at least the bottom roller will be submerged so that the emerging veneers will be under 3 or 4 inches of treating solution.

It is critical to the operation that the veneer be submerged as it emerges from the compression rollers. The thickness recovery of the veneer after compression is almost instantaneous. The veneer recovers from 95 to 97 percent of the original thickness within about 5 seconds after compression. It is during this recovery of thickness that the preservative solution becomes impregnated in the veneer. Therefore, the veneer must be submerged as it emerges from the compression roller and maintained submerged for at least 5 seconds. It is desirable to maintain the veneers submerged for time periods up to 1 minute for maximum retentions. If the veneer is allowed to recover its thickness before being submerged in the water borne preservative solution it takes several hours and in the case of some species of wood several days before sufficient treatment is accomplished.

The direction of feed of the veneer must be parallel to the grain or cell orientation on the veneer. The compressive force must be exerted perpendicular to the grain or cell orientation. It is also desirable that the veneer enter the rollers at about right angles to the opening between the rollers. This prevents damage to the wood and reduces curling in the thinner veneers.

Another very important variable in the process of my invention is the moisture content of the veneer at the time of compression. As mentioned supra, the moisture content must be above the fiber saturation point. I have found that the higher the moisture content of the veneer before squeezing the greater the retention which will be obtained. This is in direct opposition of the prior art which expressly teaches that the drier the timber the more readily it reassumes its original shape in the presence of the impregnating liquid and the more rapid and complete is the impregnation. See for example, Stamm, U.S. Pat. No. 2,350,135 and Phillips et al, British Pat. No. 597,383. In my invention the moisture content must be higher than the fiber saturation point ($\approx$30–35 percent by weight). It is preferred that the wood have a moisture content of greater than 45 percent. In fact, I have obtained excellent results with wood veneer having a moisture content of higher than 70 percent.

The rate of feed through the rollers is limited only by the retention time desired in the treating solution tank. As mentioned above, it is necessary to maintain the veneers submerged for a least about 5 seconds as they emerge from the compression rollers. However, it is preferred to maintain them submerged for at least about 10 to 30 seconds. In some cases it is desirable to maintain the veneers submerged for several minutes for maximum retention. There is no critical maximum amount of time for keeping the veneers submerged. If the veneer is kept submerged for more then 1 minute additional retention may result due to normal soaking effects.

It is also within the scope of this invention to subject the veneer to recycling or repeated squeezings. The additional compressions increase the preservative retention. Each additional pass through submerged compression rollers will increase the original retention by about 10–20 percent. However, it should be remembered that the maximum retentions obtainable depend on the particular species of wood being treated and will generally be within the range of 30 to 35 pounds of solution per cubic foot of wood. The additional compression steps may be performed by recycling the veneer through the same set of rollers. However, it is preferred to use several sets of rollers when additional compression is desirable. Generally, it will be desirable to use two sets of rollers. In addition it will seldom be necessary to pass the veneer between more than 3 sets of compression rollers.

The green veneers should be compressed to at least about one-half of their original thickness in order to obtain the desired retention. If only a small amount of retention is desirable, then the amount of compression may be reduced. Veneers of thickness up to about ⅛ inch may be compressed to ½ of their original thickness without much difficulty. However, thicker veneers, especially hardwood veneers, are sometimes more difficult to compress to this extent. Additional passes through compression rollers will compensate for the reduced compression on the thicker veneers. If a series of compression rollers are used, each successive pair of rollers may be set to compress the veneers an increasing amount to reduce the load on the first set of rollers and assist in obtaining higher retentions.

The limit in the thickness of veneers which can be compression impregnated depends on the compressibility of the particular species of wood being processed. Softer woods will allow thicker veneers to be processed. For example, double layers of ⅛ inch spruce veneers were treated by the compression impregnation process of my invention without any difficulty. However, double layers of ⅛ inch lauan veneers split when compressed to ½ of their original thickness.

It is also within the scope of my invention to pass the green veneers through a set of squeeze rollers or some other device to remove excess sap from extremely wet veneers. This pretreatment is not necessary to reduce the moisture content of the wood. The pretreatment is optional and is only necessary if sap contamination of the treating solution would create problems.

The compression impregnation process of my invention may be used to treat all the various species of veneer wood which are used to make plywood. My invention will work on both hardwood and softwood veneers. Examples of some of the commercially used veneer wood in the United States are: Ash, Beech, Birch, Cedar, Cherry, Elm, Fir, Maple, Oak, Pine, Poplar, Redwood, Spruce, and Walnut. In addition, my invention will work on the foreign woods which are being used to make plywood.

The compression impregnation process of my invention may be used to treat veneers with all types of water solutions and suspensions of treating agents. The method may be used for preservatives, fungicides, fire retardants, water repellents and resins which impart dimensional stability, acid resistance and hardness.

I have performed many experiments demonstrating the effectiveness of my invention. The following examples are illustrative of the experiments and should not be construed to limit the invention.

EXAMPLE 1

Three sets of spruce sapwood veneers were treated in accordance with the process of my invention. The veneer samples were about 6 inches wide and 12 inches long. The veneers were passed through a set of steel compression rollers. The veneers were treated in double layers, one layer of veneers being placed directly on top of another layer of veneer. The veneers were under several inches of treating solution when they emerged from the rollers. The veneers were kept submerged in the solution for about 10 seconds. The initial moisture content of the veneers was about 70 percent. The treated veneers were chemically analyzed to determine the pounds per cubic foot retention of chemical solution. The chemical solution was a 2.7 percent solution of WOLMAN CCA preservative salts. The results are shown in Table 1 below.

TABLE 1

| Experiment No. | Avg. Veneer Thickness (in.) | Roller Clearance (in.) | Cycles | Solution Retention Pounds per Cubic Foot |
|---|---|---|---|---|
| 1 | 0.066 | 0.066 | 1 | 26.5 |
| 2 | 0.069 | 0.066 | 2 | 31.5 |
| 3 | 0.068 | 0.066 | 3 | 34.5 |

The results shown in Table 1 demonstrate the effectiveness of my invention. The veneers treated by compression inpregnation retained a sufficient amount of treatment chemicals. In addition, it can be seen that each additional pass through the compression rollers increased the previous retention by about 10 percent. A visual inspection of the treated veneers showed that all knots were intact and not damaged in any manner. A sample of spruce sapwood veneer treated in a manner similar to that described above, except the veneer was treated in a single layer resulted in irreparable damage to the knots and the surrounding wood.

EXAMPLE 2

Another series of veneers were treated in accordance with the method of my invention. The veneers were about 6 inches by 12 inches in size and were of Birch and Spruce. The method used was similar to that described in Example 1 above. The treated woods were carefully analyzed to see if the use of multiple layers of veneers affected the treatment of the wood. The results are shown in Table 2 below. The initial moisture content of the veneers was about 70 percent.

TABLE 2

SOLUTION RETENTIONS ON INSIDE AND OUTSIDE FACES OF VENEERS TREATED BY THE ROLLER COMPRESSION PROCESS IN PAIRS (TO PROTECT THE KNOTS)

| Experiment No. | Species | Avg. Sample Thickness | Roller Clearance | Cycles | Solution Retention (pounds per cubic foot) Inside Face | Outside Face | Total |
|---|---|---|---|---|---|---|---|
| | | (in.) | (in.) | | | | |
| 4 | Birch | 0.067 | 0.066 | 1 | 13.4 | 12.8 | 13.1 |
| 5 | | 0.066 | 0.066 | 2 | 15.8 | 13.5 | 14.2 |
| 6 | | 0.067 | 0.066 | 3 | 18.9 | 17.6 | 18.5 |
| 7 | | 0.068 | 0.066 | 4 | 20.0 | 17.3 | 18.7 |
| 8 | Spruce | 0.033 | 0.033 | 1 | 20.3 | 22.2 | 21.2 |
| 9 | | 0.033 | 0.033 | 2 | 24.4 | 26.0 | 25.2 |

EXAMPLE 3

A series of Douglas fir, birch and spruce veneers were treated with a solution of NON-COM Exterior fire retardant chemicals (proprietary product of Koppers Co., Inc.) by the compression impregnation process of this invention. The treated veneers were dried, cured, and laid up into five ply plywood samples. These plywood samples were tested for fire retardant properties and strength properties. The fire tube test results showed that the compression impregnation method of this invention yields treated plywood having very satisfactory fire resistant properties. In addition, the results of the strength tests showed that there was no significant difference between plywood made with compression impregnated veneers and plywood made with uncompressed veneers.

EXAMPLE 4

Another series of veneers were compression impregnated in accordance with the process of my invention. These treated veneers were compared to a series of veneers which were compressed between rollers and then submerged in the treating solution. The veneers of this latter process were not submerged in the treating solution as they emerged from the compression rollers. The results are shown in Table 3 and illustrate the necessity of having the veneers submerged as they emerge from the compression rollers.

TABLE 4

| Sample No. | Veneer Species | Veneer Thickness | Times Compressed | Submerged Period | Solution Retention(pcf) |
|---|---|---|---|---|---|
| | | Veneers Compressed and Immediately Submerged | | | |
| 1 | Southern Pine | 1/8 | 2 | 5 sec. | 11.0 |
| 2 | Douglas Fir | 1/8 | 2 | 5 sec. | 8.2 |
| 3 | Spruce | 1/16 | 1 | 5 sec. | 10.2 |
| 4 | Birch | 1/16 | 1 | 5 sec. | 8.0 |
| | | Veneers Compressed While Submerged | | | |
| 5 | Southern Pine | 1/8 | 2 | 5 sec. | 24.0 |
| 6 | Douglas Fir | 1/8 | 2 | 5 sec. | 21.7 |
| 7 | Spruce | 1/16 | 1 | 5 sec. | 23.7 |
| 8 | Birch | 1/16 | 1 | 5 sec. | 18.7 |

I claim:

1. In a method for treating veneer with water borne chemical treating agents comprising passing the veneer between a pair of compression rollers such that the direction of feed of the veneer is parallel to the grain of the veneer and the compressive force exerted by the rollers is perpendicular to the grain of the veneer and the compression rollers are located such that the compressed veneer emerging from the rollers is completely submerged in the treating solution and is maintained submerged for at least about 5 seconds; the improvement comprising simultaneously passing multiple layers of veneer having a moisture content above the fiber saturation point between the compression rollers.

2. A method as in claim 1 wherein from two to five layers of veneer are simultaneously compressed.

3. A method as in claim 1 wherein two or three layers of veneers are simultaneously compressed.

4. A method as in claim 1 wherein the veneers are compressed to about one half of their original thickness.

5. A method as in claim 1 wherein at least one of the compression rollers is submerged in the treating solution.

6. A method as in claim 1 wherein the veneers are passed through more than one pair of compression rollers.

7. A method as in claim 1 wherein the veneer has a moisture content before compression greater than 45% by weight.

8. In a method for treating veneer with water borne chemical treating agents comprising passing the veneer between a pair of compression rollers such that the direction of feed of the veneer is parallel to the grain of the veneer and the compressive force exerted by the rollers is perpendicular to the grain of the veneer and the compression rollers are located such that the compressed veneer emerging from the rollers is completely submerged in the treating solution and is maintained submerged for at least about 5 seconds; the improvement comprising simultaneously passing from two to five layers of veneer having a moisture content greater than about 45% by weight between the compression rollers.

9. A method as in claim 8 wherein two or three layers of veneer are simultaneously compressed.

10. A method as in claim 8 wherein at least one of the compression rollers is submerged in the treating solution.

11. A method as in claim 8 wherein the veneers are passed through more than one pair of compression rollers.

12. A method as in claim 8 wherein the veneers are compressed to about one half of their original thickness.

* * * * *